US006243040B1

(12) United States Patent
Corey et al.

(10) Patent No.: US 6,243,040 B1
(45) Date of Patent: Jun. 5, 2001

(54) HERMETIC PACKAGE WITH EXTERNAL PATCH ANTENNA AND ASSOCIATED METHOD

(75) Inventors: Roger L. Corey, Alta Loma; Dale W. Swanson, Yorba Linda; Francis J. Woolston, Santa Ana, all of CA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/368,057

(22) Filed: Aug. 3, 1999

(51) Int. Cl.[7] ..... H01Q 1/38
(52) U.S. Cl. ..... 343/700 MS; 343/878
(58) Field of Search ..... 343/700 MS, 878, 343/702, 701, 745; H01Q 1/38

(56) References Cited

U.S. PATENT DOCUMENTS

| | | | | |
|---|---|---|---|---|
| 5,019,829 | | 5/1991 | Heckman et al. | 343/700 MS |
| 5,023,624 | * | 6/1991 | Heckaman et al. | 343/860 |
| 5,138,436 | | 8/1992 | Koepf | 357/74 |
| 5,218,373 | | 6/1993 | Heckaman et al. | 343/786 |
| 5,309,163 | * | 5/1994 | Ngan et al. | 343/700 MS |
| 5,325,103 | | 6/1994 | Schuss | 343/700 MS |
| 5,552,633 | | 9/1996 | Sharma | 257/700 |
| 5,770,816 | | 6/1998 | McNulty et al. | 174/52.3 |

* cited by examiner

*Primary Examiner*—Hoanganh Le
*Assistant Examiner*—Shih-Chao Chen
(74) *Attorney, Agent, or Firm*—Alston & Bird LLP

(57) ABSTRACT

An antenna package includes a lid-like structure that fits onto an electrically conductive, metallic box-like structure. The lid-like structure includes an electrically conductive, metallic seal member that is connected to an antenna and defines a primary opening. The antenna includes a dielectric mounted between an inner metallic layer and an outer metallic layer. The connection between the seal member and the antenna is a substantially hermetic, soldered connection between the seal member and the inner metallic layer, such that the inner metallic layer is electrically connected to the seal member. The soldered connection secures the antenna to the seal member such that the inner metallic layer occludes the primary opening. A substantially hermetic, fused connection is provided between the lid-like structure and the box-like structure so that a hermetically sealed chamber is defined within the box-like structure. Electric circuitry is positioned in the chamber and is connected to the antenna. A connector opening or openings may be defined through the seal member, and an electrical connector, such as a coaxial cable, extends through at least one of the connector openings. The lid-like structure can be formed by placing solder between the inner metallic layer of the antenna and the outer surface of the seal member, and introducing a heating tool into the primary opening so as to melt the solder and thereby solder the inner metallic layer to the seal member.

18 Claims, 5 Drawing Sheets

HERMETIC PACKAGE WITH EXTERNAL PATCH ANTENNA AND ASSOCIATED METHOD

FIELD OF THE INVENTION

The present invention relates generally to mounting antennas and, more particularly, to a hermetic microwave package with an external patch antenna.

BACKGROUND OF THE INVENTION

Many conventional microwave packages include a ceramic lid that carries circuitry and that has been metalized so as to function as a patch antenna. The lid may also define an opening or receptacle for receiving a coaxial cable. The lid is typically bonded to a metal case with a conductive epoxy. The ceramic lid is brittle and therefore prone to cracking, which can result in failure of the package. For example, one failure mechanism associated with cracking or flexing of the lid is CTE mismatch. That is, because the components of the microwave package have different coefficients of thermal expansion, temperature changes can cause the lid to flex and crack. Additionally, the epoxy seal between the lid and the case is not hermetic, such that moisture and other contaminants may reach the circuitry and cause corrosion and failure of the circuitry.

SUMMARY OF THE INVENTION

The present invention solves the problems identified above, and other problems, by providing improved antenna packages and methods of assembling or sealing the antenna packages.

In accordance with an embodiment of the invention, the antenna package includes a lid-like structure that fits onto an electrically conductive, metallic box-like structure. The lid-like structure includes an electrically conductive, metallic seal member that is connected to an antenna and defines at least one primary opening. The antenna includes a dielectric mounted between an inner metallic layer and an outer metallic layer. The connection between the seal member and the antenna is a substantially hermetic, soldered connection between the seal member and the inner metallic layer. The soldered connection electrically connects the inner metallic layer to the seal member. The soldered connection also secures the antenna to the seal member such that the inner metallic layer occludes the primary opening. However, the outer metallic layer is substantially electrically isolated from the seal member and the box-like structure by the dielectric . A substantially hermetic, fused connection is provided between the periphery of the lid-like structure and the periphery of the box-like structure so that a hermetically sealed chamber is defined within the box-like structure, thereby protecting the interior of the box-like structure from moisture and other contaminants.

In accordance with another aspect of the present invention, electric circuitry is positioned in the chamber and is connected to the antenna. A connector opening or openings are defined through the seal member, and at least one electrical connector, such as a coaxial cable, extends through at least one of the connector openings.

In accordance with one embodiment of the present invention, the lid-like structure is formed by placing solder between the inner metallic layer and the outer surface of the seal member, and thereafter introducing a heating tool into the primary opening to so as to melt the solder and thereby solder the inner metallic layer to the seal member.

Because the lid-like structure includes the seal member, which is preferably constructed of a strong metallic material and extends around the periphery of the antenna, the antenna is less prone to breaking or cracking than the above-discussed prior art lid antennas or the lid undergoes thermal cycling. Additionally, the seal member may define the one or more connector openings, such that the antenna need not itself define the connector openings, which prevents the antenna from having to be weakened by such openings. The soldered connection, which is between the seal member and the antenna, and the fused connection, which is between the lid-like structure and the box-like structure, are hermetic. Those hermetic connections reduce leakage problems that have been encountered in the past with nonhermetic connections. As a result, the circuitry of the present invention is well protected within the chamber of the box-like structure in a manner that seeks to prevent contaminants from reaching the circuitry and causing the circuitry to corrode and fail. Further, the primary opening defined by the seal member optimally provides access to the solder positioned between the seal member and the antenna such that the soldered connection between the seal member and the antenna can be efficiently and effectively formed. Further, the antenna package of the present invention is in the form of an integrated assembly that is smaller than some prior art antenna packages, such that the antenna package of the present invention provides size-related and weight-related advantages.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
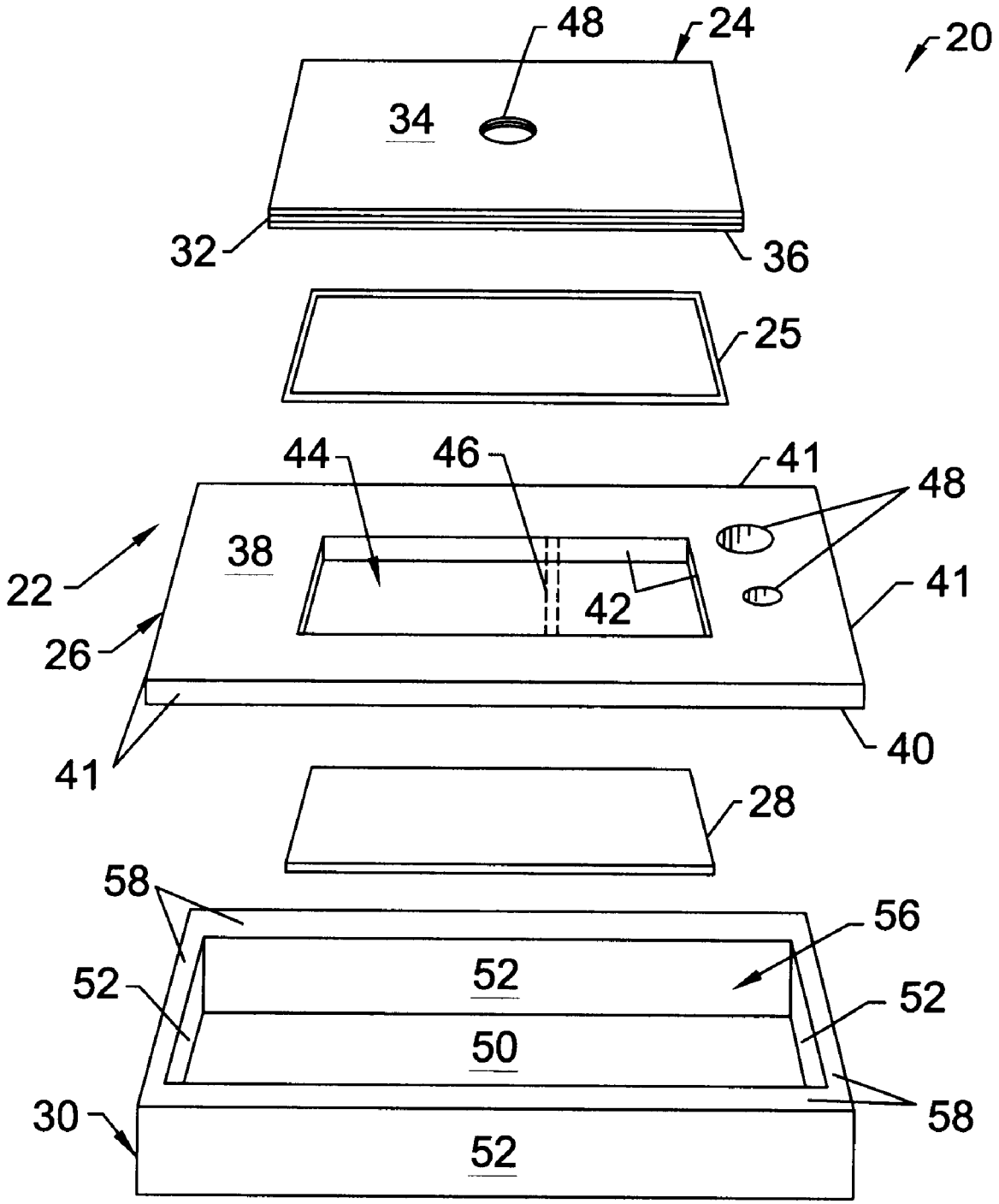
FIG. 1 is a diagrammatic, perspective exploded view of portions of an antenna package, in accordance with a first embodiment of the present invention.

Referring now to FIG. 1, portions of a microwave antenna package 20 are illustrated, in accordance with a first embodiment of the present invention. The antenna package 20 includes a lid-like structure 22, which includes a patch antenna 24 that is hermetically connected by solder 25 to a seal member 26 that structurally supports the patch antenna. The lid-like structure 22 hermetically encloses, and thereby protects, electronic circuitry 28 within a box-like structure 30.

The patch antenna 24 includes a dielectric material 32 that is secured, or sandwiched, between an inner metallic layer 36 and an outer metallic layer 34. An acceptable dielectric material 32 is a Teflon-ceramic such as RT Duroid 6010, which has a dielectric constant of 10.2±0.25 and is available from Rogers Corporation of Chandler, Ariz. Such a dielectric material is somewhat temperature sensitive, meaning that it is preferred that the antenna 24 not be directly fused, such as by resistance or laser welding, or the like, to the seal member 26 or the box-like structure 30, because such fusing may damage the dielectric material 32. The metallic layers 34 and 36 are acceptably formed by electrolytically depositing copper on the opposite sides of the dielectric material 32 such that the metallic layers are electrically isolated from one another. It may be preferred for the metallic layers 34 and 36 to be more durably attached to the dielectric material 32, such as by utilizing a belt furnace to attach the metallic layers and by using reinforcing tooling to hold the metallic layers to the dielectric material.

The seal member 26, which can be characterized as a somewhat rectangular seal ring or as a frame for holding the antenna 24, is preferably constructed of a conductive metallic material, an acceptable example of which is an alloy known as Kovar, or the like. The seal member 26 includes a generally planar outer surface 38 and a generally planar inner surface 40, both of which extend from peripheral walls 41 that extend between the outer surface 38 and the inner surface 40 and define the periphery of the seal member. The seal member 26 further includes walls 42 that extend between the outer surface 38 and the inner surface 40, and extend around and define at least one primary opening 44 that extends through the seal member 26.

As will be discussed in greater detail below, the antenna 24 is mounted to the seal member 26 such that the seal member structurally supports the antenna in a manner that seeks to prevent cracking and other damage to the antenna. The antenna 34 occludes the primary opening 44, and as will be discussed in greater detail below, the solder 25 is melted and thereafter allowed to solidify so that the solder is primarily sandwiched between the outer surface 38 of the seal member 26 and the inner metallic layer 36 of the antenna. Additionally, some of the solder 25 flows and extends between the walls 42 and the inner metallic layer 36. The solder 25 provides a soldered connection, which provides a hermetic seal, between the seal member 26 and the antenna 34. As will be discussed in greater detail below, the primary opening 44 provides access to, or access proximate to, the solder 25 so as to facilitate efficient and effective formation of the soldered connection between the antenna 24 and the seal member 26.

One or more connector openings 48 can be defined through the seal member 26 and/or the antenna 24. In accordance with a preferred embodiment of the present invention, a single connector opening 48 is defined through the antenna 24. As will be discussed in greater detail below, one or more electrical connectors that are connected to the circuitry 28 preferably pass through the connector openings 48.

The seal member 26 may include one or more reinforcing spans 46, one of which is partially illustrated by dashed lines in FIG. 1, which function to reinforce the lid-like structure 22 and provide additional structural support for the antenna 24. Whereas only a single reinforcing span 46 is illustrated in FIG. 1, multiple spans or a variety of differently shaped spans are within the scope of the present invention. For example, it may be preferred for the seal member 26 and associated spans 46 to be constructed such that a plurality of primary openings 44 are defined. For example, those plurality of primary openings may include a centered circular hole that is generally encircled by four square holes. Such a configuration results in a lid-like structure 22 of increased stiffness and strength.

The box-like package 30 is preferably constructed of a conductive metallic material, an acceptable example of which is an alloy known as Kovar, or the like. The box-like structure 30, which may also be referred to as a base, includes a bottom wall 50 and side walls 52 that extend upward from the periphery of the bottom wall so that a chamber 56 is at least partially defined between the bottom wall and the side walls. Whereas it is preferred that any necessary connector openings 48 be defined through the seal member 50, in accordance with an alternative embodiment of the present invention one or more of the walls 50 and 52 may define one or more connector openings that extend to the chamber 56. As mentioned above and discussed in greater detail below, one or more electrical connectors that are connected to the circuitry 28 pass through the connector openings.

The box-like structure 30 defines an overall length and width that are slightly greater than the length and width of the seal member 26, so that portions of upper peripheral surfaces 58 of the side walls 52 extend beyond the peripheral outer wall 41 of the seal member 26 when the lid-like structure 22 is centered with respect to the box-like structure and placed upon the upper peripheral surfaces 58. More specifically, the upper peripheral surfaces 58 preferably extend approximately 20 mils beyond the peripheral walls 41 of the seal member 26 around the entire periphery of the antenna package 20 to provide an optimal location for fusing the periphery of the lid-like structure 22 to the periphery of the box-like structure 30. As a result, a shoulder-like juncture is defined at the interface between the peripheral walls 41 of the seal member 26 and the upper peripheral surfaces 58 of the box-like structure 30.

A peripheral fused connection, or the like, is preferably formed between the lid-like structure 22 and the box-like structure 30 at the shoulder-like juncture defined at the interface between the outer walls 41 and the upper peripheral surfaces 58, such that a substantially hermetic seam is formed between the lid-like structure and the box-like structure. That is, portions of the peripheral walls 41 are fused to portions of the upper peripheral surfaces 58 to provide a hermetic seal that protects the circuitry 28. That fused connection, seal or seam may be formed by conventional resistance welding or conventional laser welding, or the like. It is preferred that the antenna 24 not be directly exposed to the heat associated with such welding because such direct exposure may damage the dielectric material 32. The antenna is connected to the seal member 26 such that the antenna is distant from the peripheral surfaces 41 and is thereby protected from the heat generated during the welding.

Figure 2:
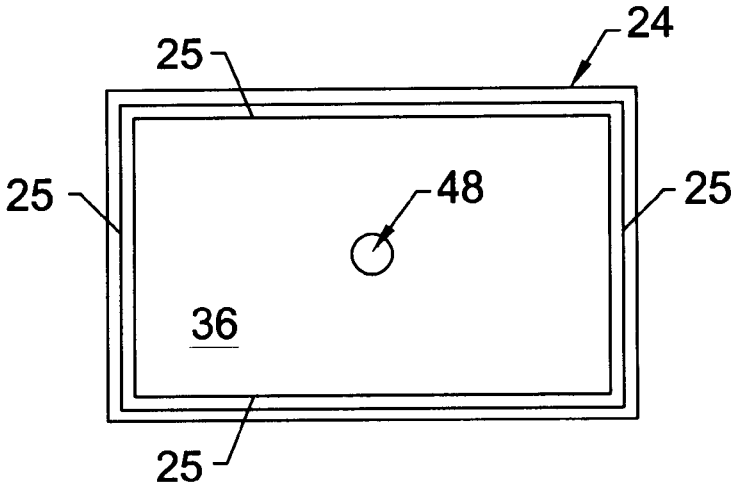
FIG. 2 is an isolated, partly assembled, bottom plan view of a patch antenna and solder of a lid-like structure of the antenna package of FIG. 1.

In accordance with an exemplary method of the first embodiment of the present invention, the lid-like structure 22 is assembled "upside-down" and thereafter the lid-like structure is inverted and secured to the box-like structure 30 such that the inner surface 40 of the seal member 26 and the inner metallic layer 36 of the antenna enclose the circuitry 28 in the chamber 56. An exemplary method of assembling the lid-like structure 22, in accordance with the first embodiment of the present invention, will now be described with reference to FIGS. 2 and 3. As best seen in FIG. 2, the patch antenna 24 is initially placed on a substantially horizontal surface so that the inner metallic layer 36 is facing upward. Thereafter, the solder 25 is placed upon the inner metallic layer 36 proximate to the periphery of the inner metallic layer, as illustrated in FIG. 2. Whereas the solder 25 is illustrated as being a continuous piece of solder in FIG. 2, it may be preferred for the solder 25 to consist of separate segments that are approximately laid end-to-end. The solder 25 is preferably tin solder that is selected from a range of solder characterized as tin 63 to tin 10, or the like, and most preferably tin 63 is used. Each of the strips of solder 25 may preferably be approximately 20 mils wide.

Figure 3:
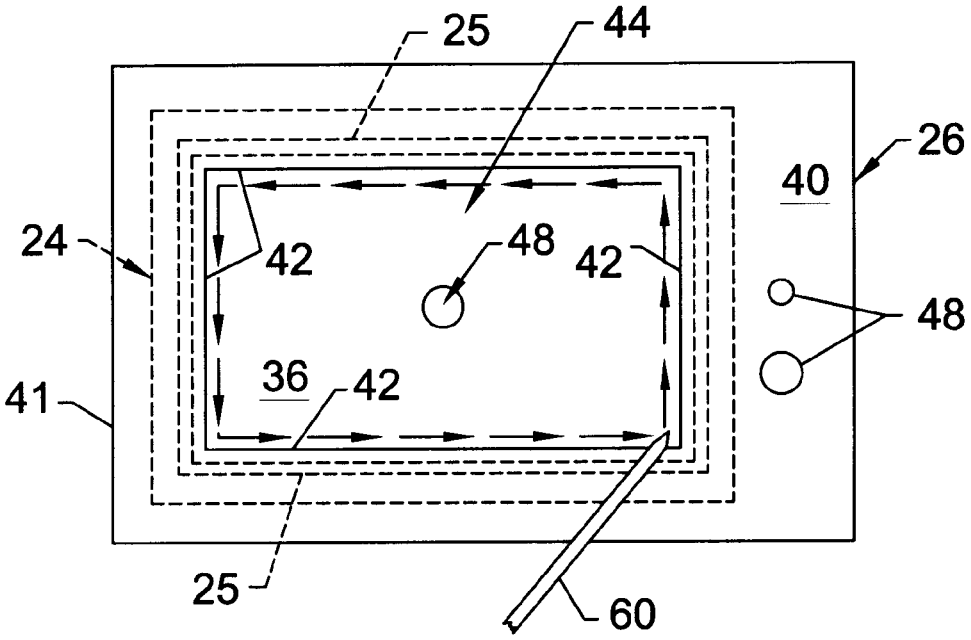
FIG. 3 is an isolated, partly assembled, bottom plan view of the lid-like structure of the antenna package of FIG. 1 being operated upon by a heating tool, in accordance with a manufacturing method of the present invention.

As best seen in FIG. 3, after arranging the patch antenna 24 and the solder 25 as discussed above with reference to FIG. 2, the seal member 26 is placed over the solder such that the inner surface 40 is upward and the solder bounds the walls 42 and the primary opening 44 defined thereby, as illustrated in FIG. 3. Thereafter, the heated tip of a heating tool 60 is positioned within the primary opening 44 and is preferably moved into contact with at least one of the inner walls 42 and the metallic layer 36. Thereafter, the heating tool is moved around the walls 42 in a manner that is illustrated by the somewhat circularly arranged arrows shown in FIG. 3. The heating tool 60 may acceptably be a soldering iron, or the like.

The above-described use of the heating tool 60 causes the solder 25 to melt and flow such that the solder spreads between the outer surface 38 (FIG. 1) of the seal member 26 and the inner metallic layer 36 of the antenna 24. A portion of the solder 25 preferably also flows slightly into the primary opening 44 and upon the walls 42 of the seal member 26. Thereafter, the solder 25 is allowed to cool, and as a result the solder forms the soldered connection, which provides a hermetic seal between the outer surface 38 of the seal member 26 and the inner metallic layer 36 of the antenna 24. Prior to assembling the lid-like structure 22 as described above, soldering flux may be painted onto a portion of the outer surface 38 of the seal member 26 around the primary opening 44 and onto the walls 42 of the seal member to promote the adherence of the solder 25 to the seal member 26.

In accordance with another embodiment of the present invention, the leaktightness of the seal formed by the solder 25 may be enhanced, if necessary, by metal plating the outer surface 38 of the seal member 26, which is best seen in FIG. 1. For example, the outer surface 38 may be plated with 100 micro inches of nickel, followed by a plating of 100 micro inches of gold. The nickel and gold are preferably not plated onto the peripheral walls 41 or the inner surface 40 of the seal member 26, so that the plating does not interfere with the above-discussed fusing of the seal member to the box-like structure 30.

Referring back to FIG. 1, when a seal member 26 incorporates one or more reinforcing cross-pieces 46, a separate narrow piece of solder 25 may be sandwiched between each of the cross-pieces and the inner metallic layer 36 of the antenna 24, and the heating tool 60 may be used to melt the one or more pieces of solder associated with the one or more cross-pieces. That is, the heated tip of the heating tool 60 is positioned within the primary opening 44 and in contact with the cross-piece 46 and an adjacent portion of the inner metallic layer 36 of the antenna 24, and the heating tool is moved along the juncture defined between the cross-piece and the inner metallic layer to melt the solder 25 that is sandwiched between the cross-piece and the inner metallic layer.

Figure 4:
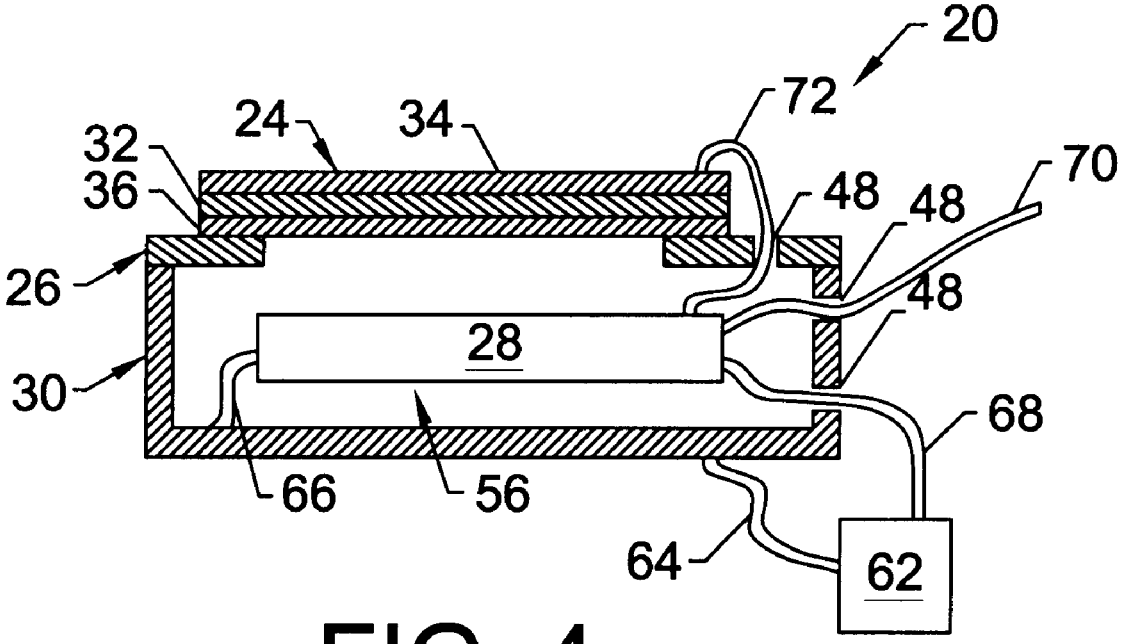
FIG. 4 is a diagrammatic, assembled, side cross-sectional view of an antenna package, in accordance with an embodiment of the present invention.

As best seen in FIG. 4, which is a diagrammatic, assembled, side cross-sectional view of an antenna package 20 in accordance with an embodiment of the present invention, the antenna package 20 preferably further includes a power supply 62. The seal member 26 and the box-like structure 30 preferably function as an electrical ground, or the like, and the power supply 62 and the circuitry 28 may be connected to the electrical ground by way of electrical connectors 64 and 66, respectively. Whereas the electrical connectors 64 and 66 are illustrated in FIG. 4, those electrical connectors may not be necessary if the power supply 62 and the circuitry 28 are directly connected to the box-like structure 30. For example, the inner metallic layer 36 of the patch antenna 24 is preferably grounded by virtue of its soldered connection to the seal member 26.

As illustrated in FIG. 4, electrical power is acceptably supplied from the power supply 62 to the circuitry 28 by way of an electrical connector 68 that extends through one of the connector openings 48. Data is preferably supplied to and/or received from the circuitry 28 by way of a data cable 70, such as a coaxial cable, that extends through one of the connector openings 48 and is connected to the circuitry. The circuitry preferably supplies signals to and/or receives signals from the outer metallic layer 34 of the patch antenna 24 by way of an electrical connector 72 that extends through one of the connector openings 48. Each of the connector openings 48 is preferably hermetically solder sealed, or the like. Whereas FIG. 4 shows connector openings 48 extending through both the box-like structure 30 and the seal member 26, it may be preferred for all of the connector openings to be defined through the seal member, and it may be most preferred for the package 20 to include only one connector opening which is defined through the antenna 24.

As a result of the above-discussed seals, the circuitry 28 is hermetically sealed within the chamber 56. The chamber 56 preferably further contains one or more gases that are inert with respect to the circuitry 28, so that the circuitry is protected within the chamber. The concentration of the inert gas within the chamber 56 is preferably greater than the concentration of the inert gas in the ambient air, and preferably the inert gas is substantially the only gas within the chamber. The inert gas is acceptably nitrogen, or the like.

Figure 5:
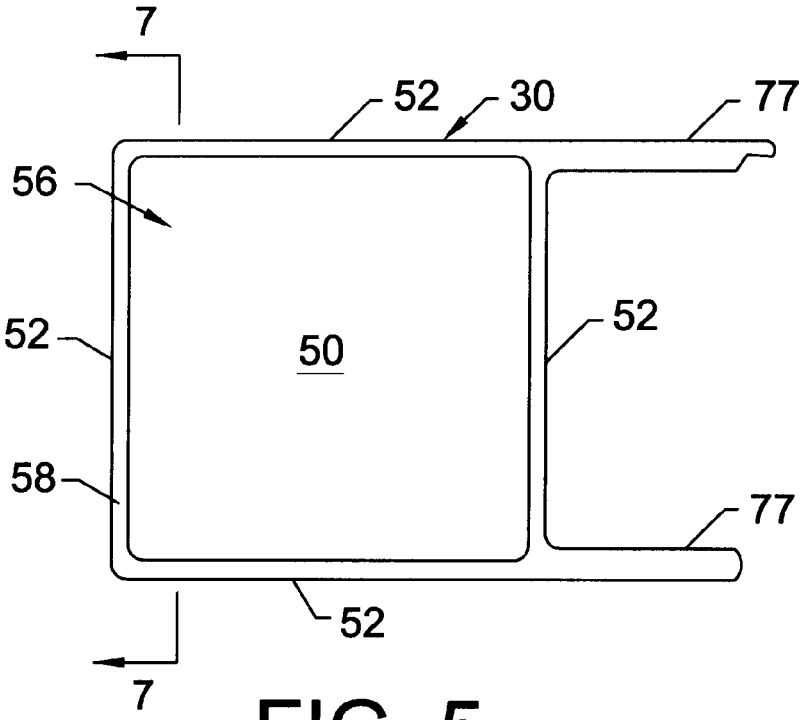
FIG. 5 is an isolated, top plan view of a box-like structure of an antenna package, in accordance with a second embodiment of the present invention.
Figure 6:
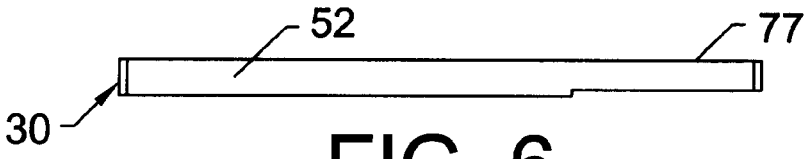
FIG. 6 is a side elevation view of the box-like structure of FIG. 5.
Figure 7:
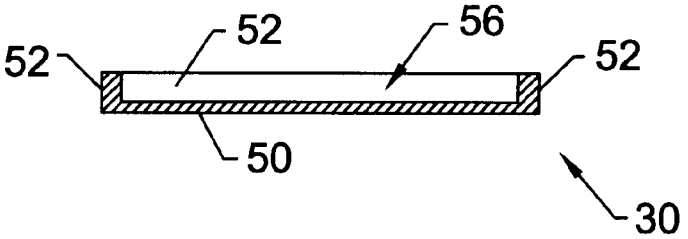
FIG. 7 is a cross-sectional view of the box-like structure of FIG. 5 taken along the line 7—7 of FIG. 5.
Figure 8:
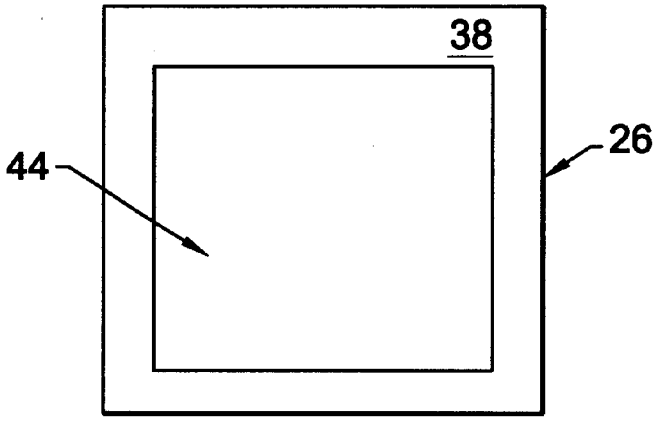
FIG. 8 is an isolated, top plan view of a seal member of an antenna package, in accordance with the second embodiment of the present invention.
Figure 9:
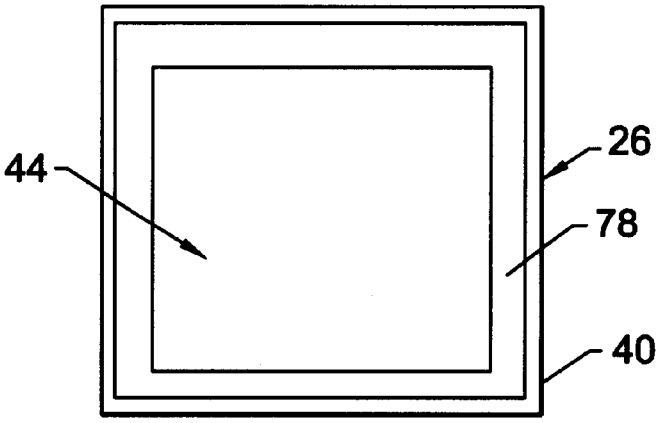
FIG. 9 is a bottom plan view of the seal member of FIG. 8.
Figure 10:
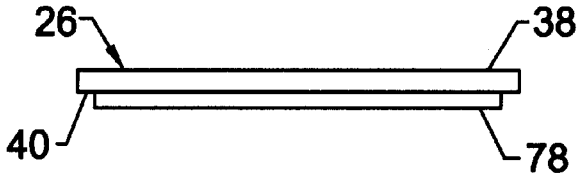
FIG. 10 is an elevation view of the seal member of FIG. 8.

FIGS. 5–10 respectively illustrate a box-like structure 35 and a seal member 26 of an antenna package of a second embodiment of the present invention. The antenna package of the second embodiment is like the above-discussed antenna packages of the present invention, except for variations that are noted and variations that will be apparent to one skilled in the art in view of this disclosure. FIGS. 5 and 6 are top plan and side elevation views, respectively, of the box-like structure 30 of the second embodiment of the present invention. FIG. 7 is a cross-sectional view of the box-like structure 30 of FIG. 5 taken along line 7—7 of FIG. 5. FIGS. 8–10 are respectively top plan, bottom plan, and side elevation views of the seal member 26 of the second embodiment of the present invention.

As best seen in FIGS. 5 and 6, in accordance with the second embodiment of the present invention, the box-like structure 30 further includes a pair of extensions 77 between which a power supply (for example see the power supply 62 of FIG. 4) may be mounted. As best seen in FIGS. 9 and 10, the seal member 26 of the second embodiment further includes a step 78 that extends around the primary opening 44 and is received within the chamber 56 (FIGS. 5 and 7) in a manner that promotes the fitting of the seal member onto the box-like structure 30.

The antenna package 20 has many possible applications, including, but not limited to, modular phase-array antennas, hand-held Global Positioning System receivers and satellite data transmitters.

The antenna package 20 of the present invention provides many advantages. For example, the antenna 24 is supported by the seal member 26 in a manner that seeks to prevent breakage of the antenna. Additionally, the seal member 26 preferably defines the one or more connector openings 48, such that the antenna 24 need not itself define the connector openings, which prevents the antenna from having to be weakened by such openings. The soldered connection, which is between the seal member 26 and the antenna 24, and the fused connection, which is between the lid-like structure 22 and the box-like structure 30, are hermetic. Those hermetic connections reduce leakage problems. As a result, the circuitry 28 is well protected within the chamber 56 of the box-like structure 30 in a manner that seeks to prevent contaminants from reaching the circuitry and causing circuitry to corrode and fail. Further, the primary opening 44 defined by the seal member 26 optimally provides access proximate to the solder 25 positioned between the seal member and the antenna 24 such that the soldered connection between the seal member and the antenna can be efficiently and effectively formed. Further, the antenna package of the present invention is in the form of an integrated assembly that provides size-related and weight-related advantages.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An antenna package, comprising:

a first structure, comprising:

an electrically conductive seal member defining at least one opening, an antenna comprising a dielectric mounted between an inner metallic layer and an outer metallic layer, and a substantially hermetic, soldered connection between the seal member and the inner metallic layer, wherein the soldered connection secures the antenna to the seal member such that the inner metallic layer occludes the opening;

a second structure; and a substantially hermetic connection between the first and second structures, wherein at least the first and second structures, the hermetic connection between the first and second structures and the soldered connection are such that a substantially hermetically sealed chamber is defined at least between the first and second structures.

2. An antenna package according to claim 1, wherein the second structure is a box-like structure and the first structure is a lid-like structure for the box-like structure.

3. An antenna package according to claim 1, wherein the outer metallic layer is substantially electrically isolated from the seal member and the second structure.

4. An antenna package according to claim 1, wherein:

the seal member comprises a peripheral part;

the second structure comprises a peripheral part; and the hermetic connection between the first and second structures comprises a fused connection between the peripheral part of the seal member and the peripheral part of the second structure.

5. An antenna package according to claim 1, wherein:

the seal member comprises:

an outer surface, wherein at least a portion of the outer surface is adjacent the inner metallic layer, an inner surface, wherein at least a portion of the inner surface faces and at least partially defines the chamber, and at least one wall extending between the inner and outer surfaces of the seal member and at least partially extending around the opening; and the soldered connection extends between at least a portion of the outer surface of the seal member and at least a portion of the inner metallic layer, and the soldered connection also extends between at least a portion of the wall of the seal member and at least a portion of the inner metallic layer.

6. An antenna package according to claim 5, wherein at least a portion of the inner metallic layer faces and at least partially defines the chamber.

7. An antenna package according to claim 5, wherein the outer surface of the seal member comprises plating that is adjacent the inner metallic layer of the antenna.

8. An antenna package according to claim 1, further comprising electronic circuitry positioned in the chamber and an electrical connection between the electronic circuitry and the antenna.

9. An antenna package according to claim 8, further comprising an inert gas within the chamber, wherein the concentration of the gas within the chamber is greater than the concentration of the gas in the ambient air.

10. An antenna package according to claim 9, wherein the gas is nitrogen.

11. An antenna package according to claim 8, wherein:

the package defines a second opening; and a data cable extends through the second opening and is connected to the electronic circuitry.

12. An antenna package according to claim 11, wherein the second opening is defined through the seal member.

13. An antenna package according to claim 8, wherein the electrical connection between the antenna and the electric circuitry comprises an electrical connector extending between the electronic circuitry and the antenna.

14. An antenna package according to claim 13, wherein:

the package defines a second opening; and the electrical connector extends through the second opening and comprises a first end connected to the electronic circuitry and a second end connected to the outer metallic layer of the antenna.

15. An antenna package according to claim 14, wherein:

the package defines a third opening; and a data cable extends through the third opening and is connected to the electronic circuitry.

16. An antenna package according to claim 15, wherein the second and third openings are defined through one or more parts of the package selected from the seal member and the second structure.

17. A method of forming an antenna package, comprising the steps of:

forming a first structure by connecting an inner metallic layer of an antenna to an outer surface of an electrically conductive seal member so that the inner metallic layer hermetically occludes an opening defined through the seal member and an outer metallic layer of the antenna is electrically isolated from the seal member, wherein the connecting step comprises the steps of:

placing solder between the inner metallic layer of the antenna and the outer surface of the seal member, and introducing a heating tool into the opening to so as to melt the solder and thereby solder the inner metallic layer to the seal member; and connecting the first structure to a second structure such that an at least partially hermetically sealed chamber is defined at least between the first and second structures.

18. The method of claim 17, wherein the step of placing solder comprises the steps of:

placing the antenna on a substantially horizontal surface so that the inner metallic layer is facing upward;

placing solder on the inner metallic layer while the inner metallic layer is facing upward; and placing the outer surface of the seal member on the solder while the inner metallic layer is facing upward and the solder is upon the inner metallic layer.

* * * * *